US005777857A

United States Patent [19]

Degelmann

[11] Patent Number: 5,777,857

[45] Date of Patent: Jul. 7, 1998

[54] ENERGY EFFICIENT LIGHTING SYSTEM

[75] Inventor: Paul G. Degelmann, Americus, Ga.

[73] Assignee: Cooper Industries, Inc., Houston, Tex.

[21] Appl. No.: 543,824

[22] Filed: Oct. 16, 1995

[51] Int. Cl.[6] ..... F21S 1/02

[52] U.S. Cl. ..... 362/150; 362/260; 362/225; 362/365

[58] Field of Search ..... 362/225, 260, 362/219, 150, 290, 354, 365; 52/28

[56] References Cited

U.S. PATENT DOCUMENTS

| | | | |
|---|---|---|---|
| 3,591,798 | 7/1971 | Florence . | |
| 3,816,880 | 6/1974 | Jacobs | 362/150 |
| 4,047,336 | 9/1977 | Stahlhut et al. | 52/28 |
| 4,363,082 | 12/1982 | Roland | 362/225 |
| 4,424,554 | 1/1984 | Woloski et al. | 362/365 |
| 5,161,878 | 11/1992 | Degelmann et al. | 362/150 |
| 5,226,724 | 7/1993 | Kanarek | 362/219 |
| 5,386,353 | 1/1995 | Battaglia | 362/260 |
| 5,412,551 | 5/1995 | Newell | 362/260 |

FOREIGN PATENT DOCUMENTS

| | | | |
|---|---|---|---|
| 264857 | 4/1988 | European Pat. Off. | 362/260 |

OTHER PUBLICATIONS

ERCO Program 1991/93, Lighting brochure.
ParaLyte 848, Recessed Fluorescent Lighting brochure.
Lightolier, The Central Trough System.
Siemens, SiDeko, Mounted and Recessed Ceiling Luminaires with variable Lighting Technology, brochure.

*Primary Examiner*—Thomas M. Sember
*Attorney, Agent, or Firm*—Burns, Doane, Swecker & Mathis LLP

[57] ABSTRACT

The lighting system according to the present invention is based on a modular lighting component or fixture which is designed to accommodate a single T8 (1" diameter) fluorescent tube. The T8 fluorescent tube which is smaller than the widely used T12 fluorescent tube is more efficient and lower powered than the more common T12 lamp. The modular system of fixtures each contain only one lamp and allow the end user to couple the correct quantity of fixtures to meet both the lighting requirements and the power density limitations of any application. The modular system of fixtures along with a system for coupling the fixtures allows extreme flexibility of layout designs for a variety of applications. The individual lighting fixture includes a lamp housing in which the single T8 light source is mounted, electrical connections for the light source, side reflectors and a plurality of cross vanes or louvers extending transversely below the light source. The individual lighting fixtures may be mounted individually, in twin-paks, or in rows to provide a wide assortment of lighting designs available to the lighting designer.

23 Claims, 6 Drawing Sheets

ENERGY EFFICIENT LIGHTING SYSTEM

BACKGROUND OF THE INVENTION

1. Field of the Invention

The present invention relates to overhead recessed, surface and suspended lighting fixtures or luminaries used in direct or direct indirect lighting applications and more particularly the invention relates to an efficient modular system of luminaires which may be adapted to a particular lighting situation.

2. Description of the Related Art

Conventional overhead recessed lighting fixtures or luminaries are designed to conform to conventional suspended ceilings of 2'×2' modular construction. These conventional lighting fixtures include a large metal housing with dimensions of 2'×4' and either a plurality of louvers or a prismatic diffuser which functions to direct light from fluorescent lamps. These housings accommodate a number of lamps. Usually four, T12 (1½ inch diameter) fluorescent type lamps are accommodated in one housing. Common practice in the installation of these conventional 2'×4' fixtures in a ceiling grid involves elimination of alternating 2 foot cross T's in the ceiling grid to fit the 2'×4' fixtures.

New lighting industry standards in office and commercial lighting are requiring lower lighting levels which provide energy savings and a more comfortable working environment. In addition, improvements in light directing louvers and diffusers provide more illumination power from the same light source. In order to meet these new lighting standards and to take advantage of improved light directing devices, the conventional installation of the 2'×4' luminaire has been modified by increasing the spacing between such conventional luminaires to achieve energy savings and lower lighting levels. Alternatively, the number of fluorescent lamps provided in a single fixture may be reduced by leaving some of the lamps out to achieve energy savings. However, taking existing fixtures and incorporating fewer lamps is a waste of precious materials.

Another type of lighting fixture which is available to lighting designers is a luminaire which is designed around a single T12 lamp, however, this T12 fixture is of such a size that it does not fit easily into the conventional ceiling grids. Conventional ceiling grids include main T-sections mounted every four feet and cross T-sections connecting the main T-sections at two foot intervals. Each of the main and cross T-sections is provided with six inch planning modules or notches located at six inch increments for attachment of additional cross T sections. Since the available prior art fixture including one T12 lamp described above is seven inches or greater in width, it is not compatible with the six inch planning modules of well known ceiling grids. Therefore, additional materials and time are required to adapt the existing ceiling grids to fit these odd sized T12 fixtures.

An example of a prior art lighting system using conventional 2'×4' luminaires 30 and perimeter luminaries 32 is shown in FIG. 3. When this prior art lighting system is installed as shown in FIG. 3, in a 3240 by 42' open room, illumination levels of 70 fcm with power densities of 1.42 watts per square foot are achieved.

There is a need for illumination systems which achieve lower illumination levels and increased energy efficiency to meet new requirements being mandated by State and Federal Government legislation. Energy efficient standards are limiting the energy usage for lighting. In addition, building codes are demanding lower profile lighting products which take up less ceiling space. Therefore, there is a need for a compact, energy efficient, luminaire which is compatible with all types of grid ceiling systems.

SUMMARY OF THE INVENTION

The present invention provides an illumination system which is energy efficient by employing modular lighting fixtures dedicated to the smaller and more efficient T8 fluorescent lamps. This modular system is adaptable for use in a variety of lighting applications.

The invention relates to a lighting system including a plurality of lighting fixtures, each of which includes a housing sized to be received in a six inch wide ceiling grid planning module and an electrical connection adapted to receive a T8 fluorescent lamp. The lighting system is compatible with a suspended ceiling grid system having standard planning modules for receiving modified ceiling tiles and fixture openings sized to receive one or more of the of lighting fixtures.

Another aspect of the invention relates to a lighting fixture for use in a suspended ceiling which includes an elongated housing having an interior and an exterior surface, means for supporting a T8 fluorescent lamp in the interior of the housing so that the lamp extends along a longitudinal length of the housing, reflectors positioned along the interior of the housing on opposite side surfaces of the housing, and shielding means mounted on the housing for directing light from the fluorescent lamp. The exterior surface of the elongated housing is sized to be received in a six inch by four foot ceiling grid planning module.

BRIEF DESCRIPTION OF THE DRAWING FIGURES

The invention will be described in greater detail with reference to the accompanying drawings in which like elements bear like reference numerals, and wherein.

DETAILED DESCRIPTION

The lighting system according to the present invention is based on a modular lighting component or fixture which is designed to accommodate a single T8 (⅛ or 1 inch diameter) fluorescent tube 10. The T8 fluorescent tube which is incorporated in the fixtures of the present invention is smaller than the widely used T12 fluorescent tube. In addition, the T8 lamp is more efficient and lower powered than the more common T12 lamp. The modular system of fixtures according to the present invention allows the end user or lighting designer to couple the correct quantity of fixtures to meet both the lighting requirements and the power density limitations of any application without compromise. The modular system along with a coupling system allows extreme flexibility of layout designs for a variety of applications.

Figure 1:
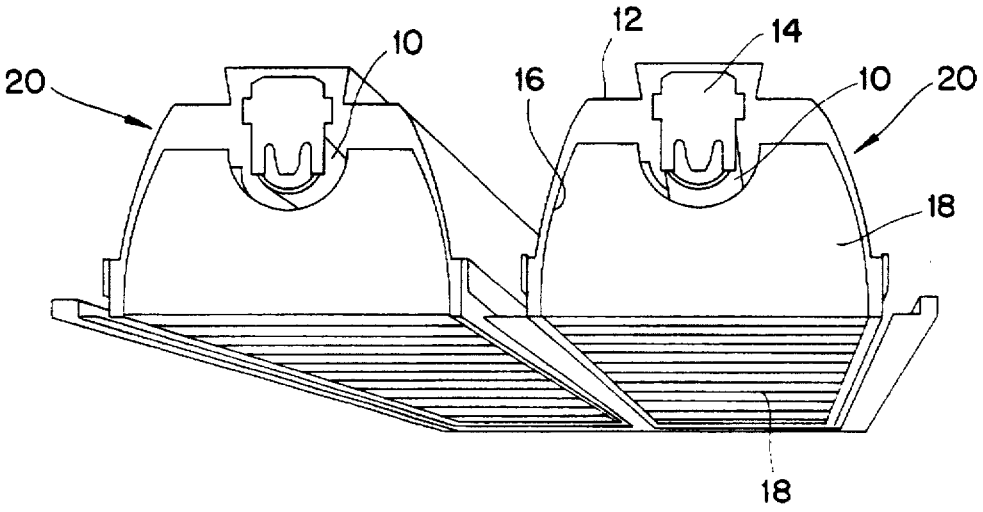
FIG. 1 is a schematic perspective view of two of the lamp fixture modules according to the present invention.
Figure 2:
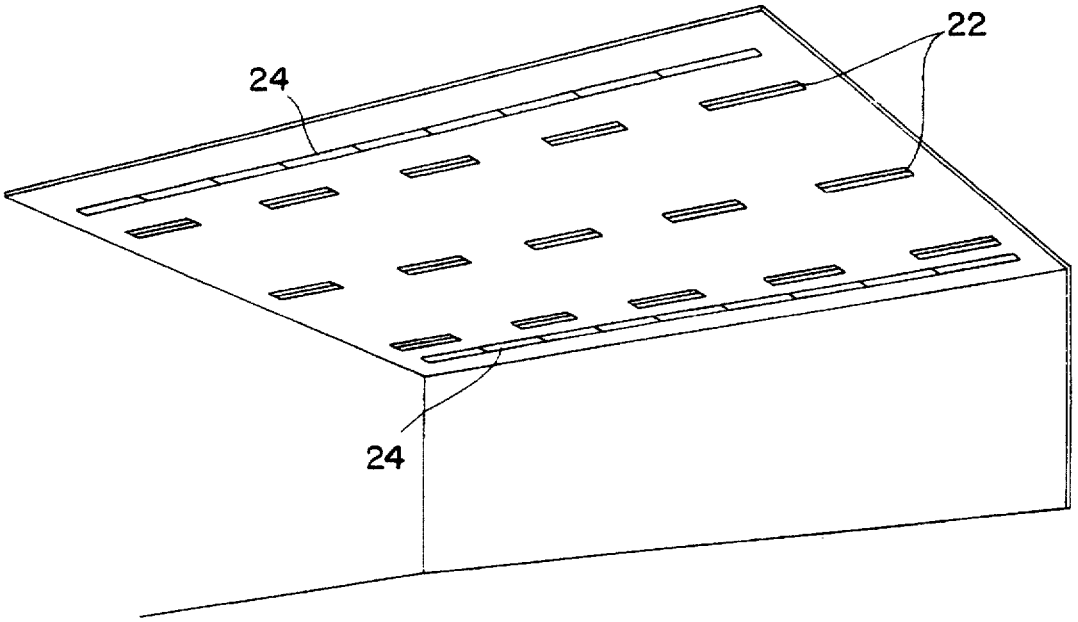
FIG. 2 is a perspective view of a room including a lighting system according to the present invention.

The individual lighting fixture 20 two of which are shown in FIG. 1, includes a lamp housing 12 in which the single T8 light source 10 is mounted, electrical connections 14 for the light source, side reflectors 16 and a plurality of cross vanes or louvers 18 extending transversely below the light source. The individual lighting fixtures 20 may be mounted individually, in twin-paks, as shown in FIG. 1, or in rows to provide a wide assortment of lighting designs available to the lighting designer. As shown in FIG. 2, a large open room may be lit by twin-paks 22 of lighting fixtures 20 which are spaced throughout the room and rows 24 of lighting fixtures 20 along the side walls.

The lighting fixture 20 is designed to fit into a 6 inch by 4 foot ceiling grid spacing or standard planning module. Since conventional ceiling grids are provided with 2'×2' grids having six inch (152.4 mm) planning modules, the integration of one, two, three, or four fixtures into a single 2'×4' ceiling grid opening is easily accommodated. The lighting fixture 20 of the present invention preferably has a maximum depth of 3.5 inch (88.9 mm) or in cases where a micro electronic ballast (not shown) is incorporated the fixture has a 4.125 inch (104.8 mm) maximum depth. The lighting fixture 20 of the present invention is noticeably smaller than the existing fixtures which have depths of 5.5 inches (139.7 mm). These extremely shallow luminaire depths of the present invention meet the new building codes which incorporate restricted plenum depths.

In addition, the fixture according to the present invention provides an aperture opening of approximately 4.6 inches (116.8 mm). This small aperture width is substantially smaller than the 7 inch (177.8 mm) apertures of the existing fixtures incorporating T12 lamps.

Figure 4:
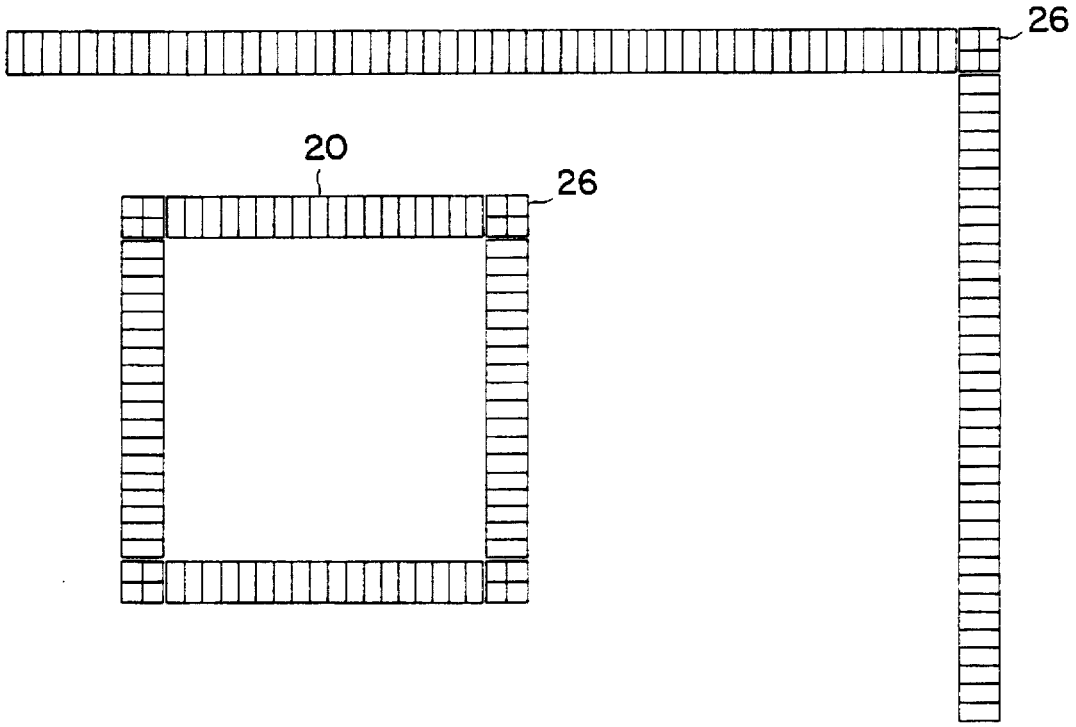
FIG. 4 is a schematic view of two configurations of lighting elements according to the present invention.

The present invention provides the lighting designer with a wide variety of design options which were not previously available to achieve more efficient lighting. Two such lighting options are shown in FIG. 4. In order to accomplish the lighting configurations shown in FIG. 4, corner transition section fixtures 26 are provided in addition to the elongated modular fixtures 20. The corner transition section fixtures 26 fit into a 6 inch by 6 inch planning module in the ceiling grid. The corner fixtures 26 are adapted to receive a 7 watt compact fluorescent lamp.

Figure 5:
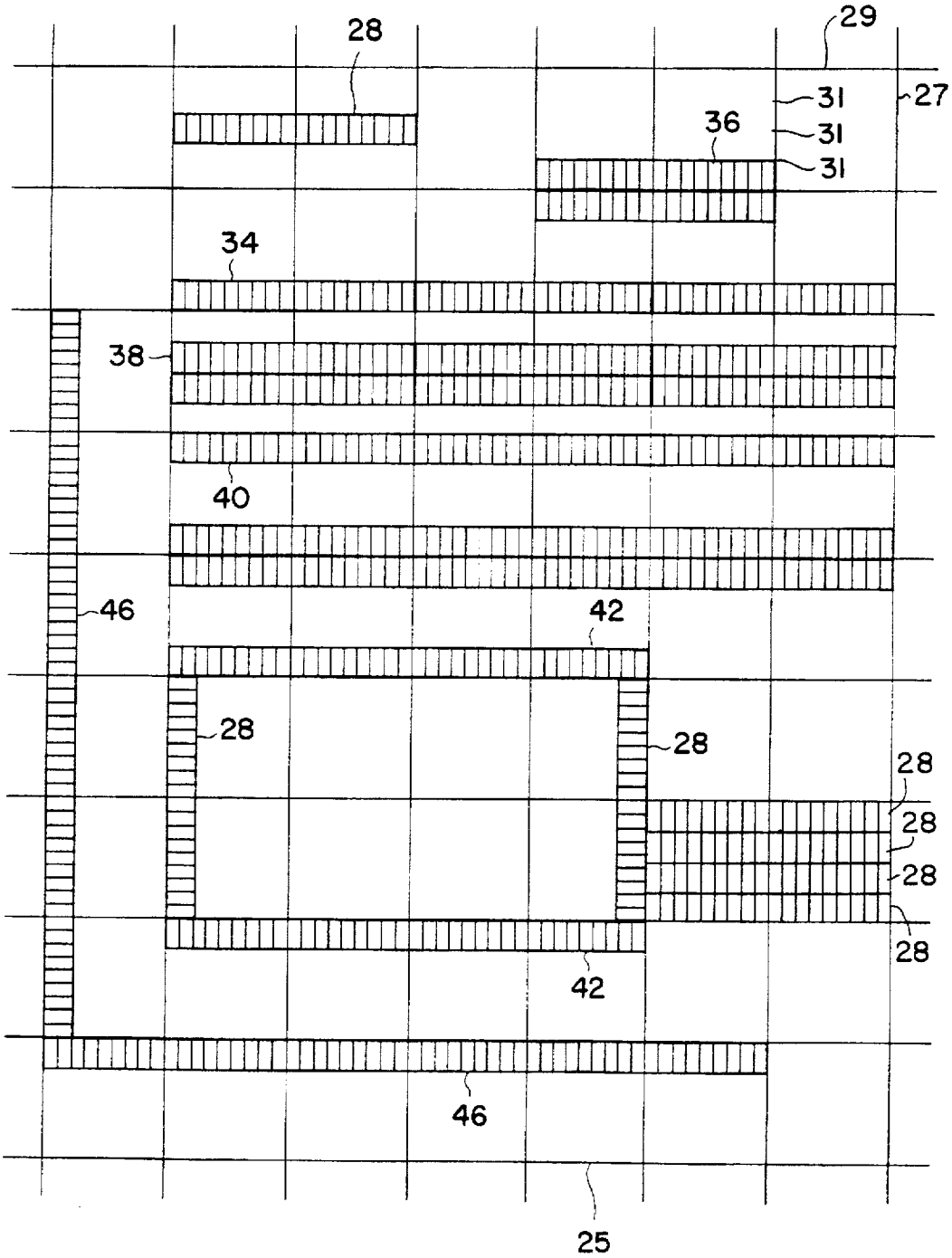
FIG. 5 is a schematic view of additional configurations of lighting elements according to the present invention.
Figure 6A:
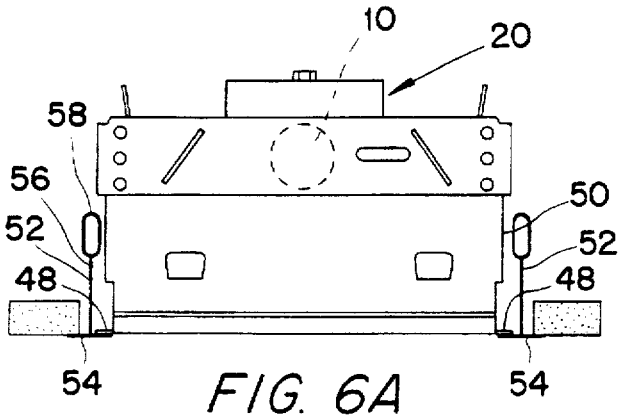
FIG. 6A is an end view of a fixture according to the invention mounted in a standard grid ceiling.
Figure 6B:
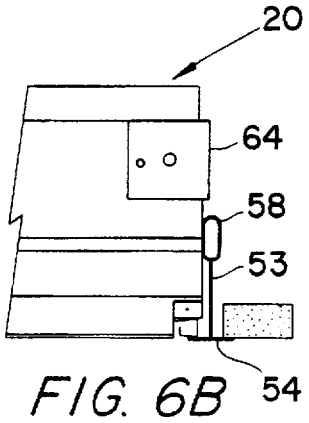
FIG. 6B is side view of a portion of the fixture of FIG. 6A mounted in a standard grid ceiling.

FIG. 5 shows additional configurations in which the lighting fixtures may be mounted in a 2'×2' ceiling grid 25. Grid 25 includes main T-sections 27 and cross T-sections 29, with each of the main 27 and cross 29 T-sections being provided with notches 31 corresponding to the planning module size. According to the present invention, fixtures may be mounted individually 28 or in a row 34 with individual fixtures mounted end to end. Fixtures may also be mounted in individual twin-paks 36 or in rows of twin-paks 38. As an alternative to mounting individual fixtures in rows, continuous row fixtures 40 may be provided in increments of four feet in length. For example, two eight foot rows 42 may be combined with two individual four foot fixtures 28 to form a rectangular lighting configuration. In addition, twelve foot row fixtures 46 can be provided which are particularly suitable for use in perimeter continuous row lighting. Further, four individual four foot lighting fixtures 28 may be mounted within one rectangular ceiling grid.

Figure 3:
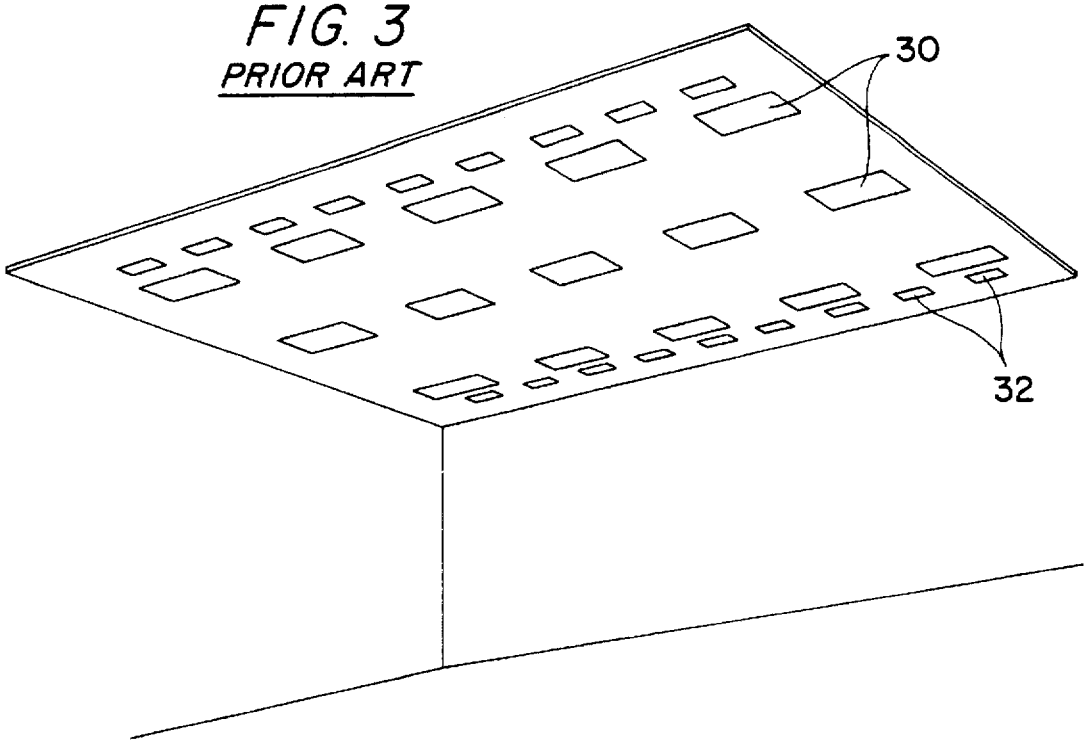
FIG. 3 PRIOR ART
FIG. 3 is a perspective view of a room including a lighting system according to the prior art.

The illumination system of the present invention installed as shown in FIG. 2, which includes general lighting with twin-paks 22 and perimeter lighting with rows 24, in the same area as the prior art lighting system of FIG. 3 (32'×42' open room) provides illumination levels of 50 fcm at a power density of less than 1.00 watts per square foot. This illumination system reduces the energy demand by one third over the prior art lighting system shown in FIG. 3 which provides illumination levels of 70 fcm with power densities of 1.42 watts per square foot.

FIGS. 6–9 show more specifically how the lighting fixtures of the present invention are mounted in standard 2'×2' or 2'×4' grid ceilings. As shown in FIG. 6A, the lighting fixture 20 is provided with flanges 48 which extend from the lower edges of both sides 50 of the fixture along the length of fixture. According to the present invention, the ceiling grid is configured to include cross T-sections 52 which are spaced six inches apart to receive the lighting fixture 20. Each of the cross T-sections 52 includes a horizontal ceiling tile supporting portion 54 and a vertical connecting portion 56 having an enlarged section 58 along an upper edge. The lighting fixture 20 is also supported on the ends 64 by the main T-section 53. As shown in FIGS. 6A and 6B, according to the first embodiment of the invention, the fixture is supported on all four sides by the horizontal supporting portions 54 of the surrounding cross T-sections 52 and main T-sections 53.

Figure 7A:
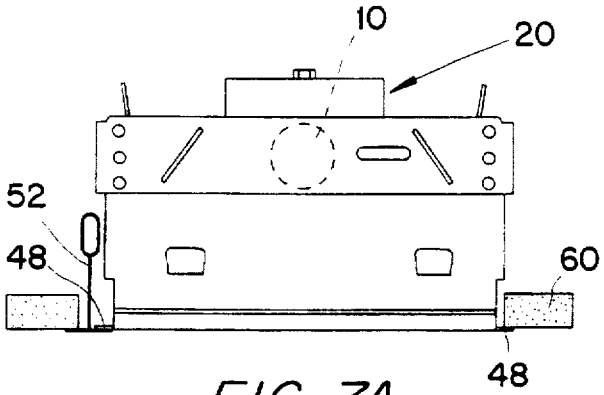
FIG. 7A is an end view of a fixture according to the present invention mounted in a standard grid ceiling and having a ceiling tile support on one side.
Figure 7B:
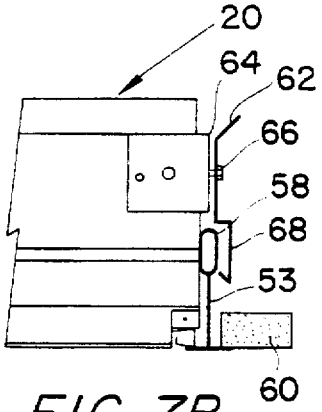
FIG. 7B is a side view of a portion of the fixture of FIG. 7A mounted in a standard grid ceiling.

Alternatively, as shown in FIG. 7A, a cross T-section on one side (the right side) of the fixture 20 may be omitted and one of the flanges 48 of the fixture may be used to support the ceiling tile 60 on the side of the fixture on which the cross T-section is omitted. In this case however, in order to secure the fixture 20, it is necessary to provide an end support bracket 62 which is attached to the end 64 of the fixture, as shown in FIG. 7B. The end support bracket 62 is attached to the end of the fixture by a screw 66 such that the bracket is adjustable vertically to accommodate main T-sections 53 of different sizes. The bracket 62 has a clamping portion 68 which extends over the enlarged section 58 on the top edge of the main T-section 53 to secure the fixture 20 in place at both of the ends 64 of the fixture.

Figure 8A:
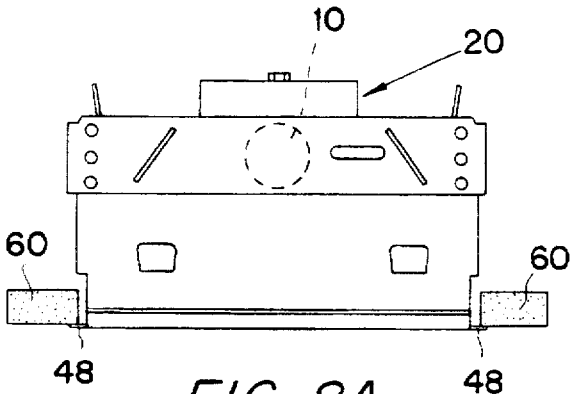
FIG. 8A is an end view of a fixture according to the present invention mounted in a standard grid ceiling and having ceiling tile supports on both sides.
Figure 8B:
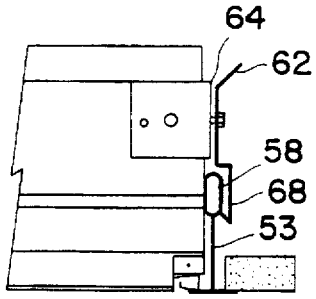
FIG. 8B is a side view of a portion of the fixture of FIG. 8A mounted in a standard grid ceiling.

In another alternative embodiment, as shown in FIGS. 8A and 8B, both cross T-sections may be omitted, for example, where the fixture is mounted in the center of a ceiling tile grid for aesthetic or illumination reasons. In this case, the fixture 20 may be supported only at the two ends 64 by end support brackets 62. In this embodiment the flanges 48 on the sides of the fixture are used to support the ceiling tiles 60 adjacent the fixture.

Figure 9A:
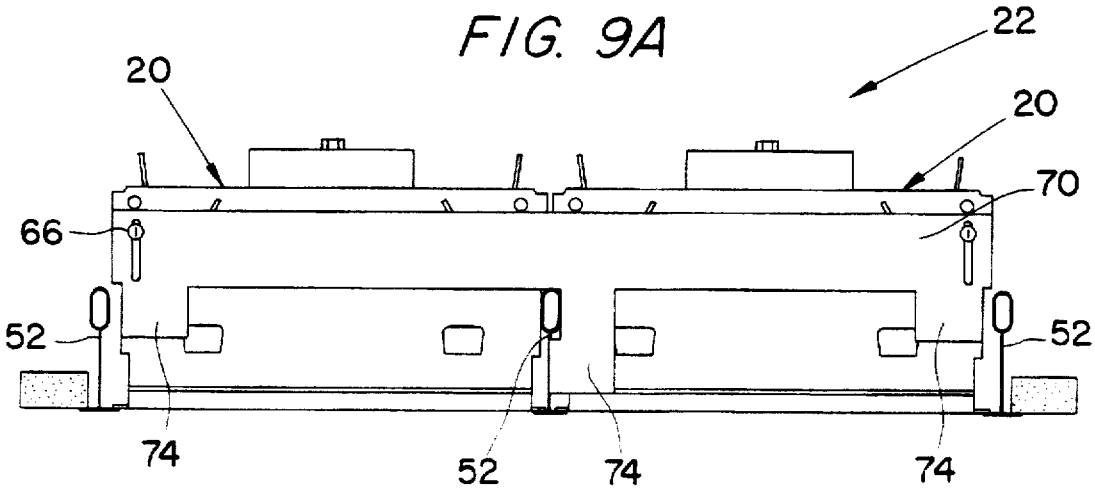
FIG. 9A is an end view of a twin-pak according to the present invention which straddles a T-bar of a standard grid ceiling.
Figure 9B:
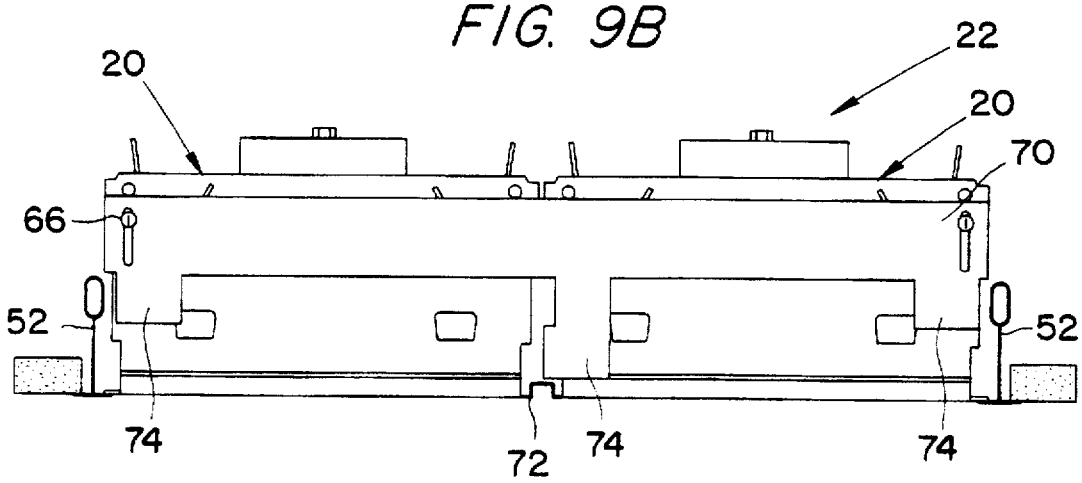
FIG. 9B is an end view of a twin-pak according to the present invention having a center extrusion.

FIGS. 9A and 9B are end views of twin-paks 22 of fixtures which have been mounted in a ceiling grid. According to the present invention, an end bracket 70 is provided at both ends of the fixtures 20 and is secured to the ends of the fixtures by screws 66. The twin-pak 22 may be supported by cross T-sections 52 on both sides and in the center as shown in FIG. 9A. Alternatively, the center cross T-section may be omitted and the twin-pak 22 may be provided with a center extrusion 72 or molding which gives the twin-pak a finished appearance.

The end bracket 70 is preferably provided with clamping members 74 which function in the same manner as the clamping members 68 shown in FIGS. 7B and 8B to secure the ends of the twin-pak to the main T-sections. Although a single bracket with three clamping positions 74 is shown, other clamping members may be incorporated as necessary.

Figure 10:
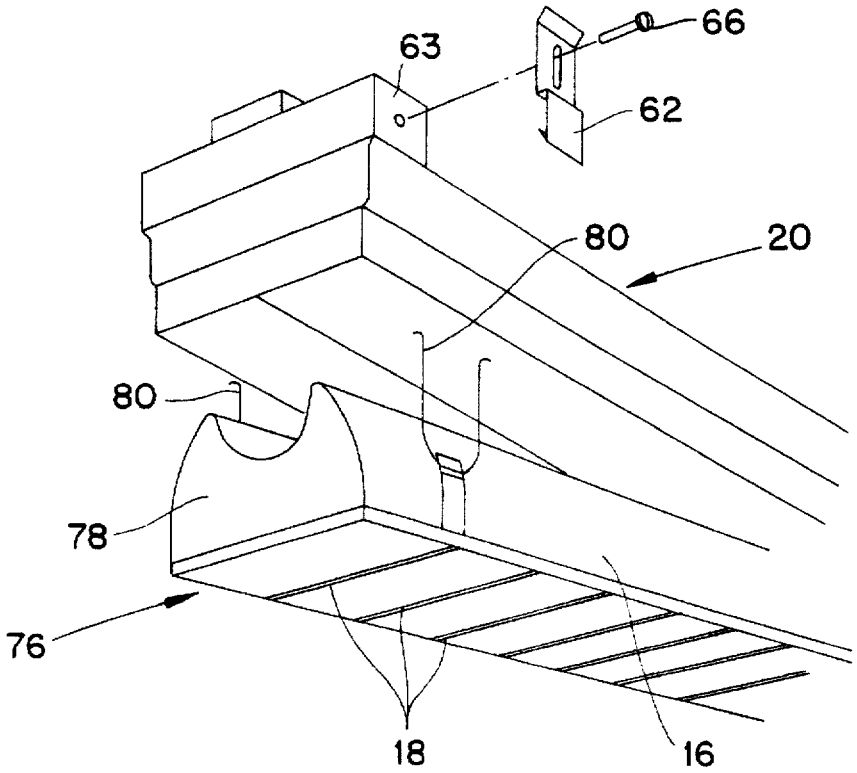
FIG. 10 is a bottom perspective view of a portion of a fixture according to the invention with the louver assembly partially removed.
Figure 11:
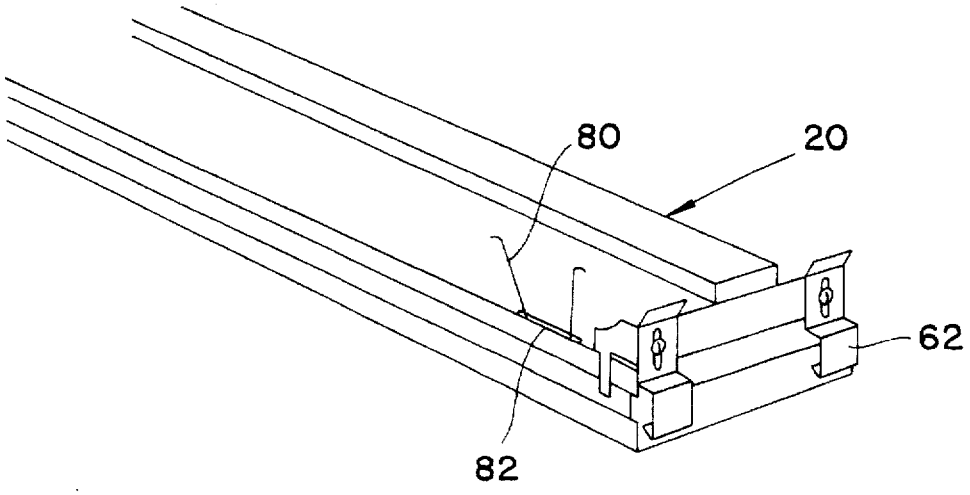
FIG. 11 is a top perspective view of the fixture of FIG. 10 with the louver assembly locked in place.

FIG. 10 shows a portion of a fixture 20 according to the present invention with the louver assembly 76 partially removed. The louver assembly 76 includes side reflectors 16, end vanes 78 and a plurality of louvers or cross vanes 18 which extend transverse to the fluorescent lamp along the length of the fixture 20. The cross vanes 18 and end vanes 78 are described in U.S. Pat. No. 5,528,478, having the same inventor as the present application, which is incorporated herein by reference. The louver assembly 76 is attached to the fixture 20 by torsion springs 80 which are affixed to the sides of the louver assembly in any known manner. The torsion springs 80, as seen in FIG. 11 extend through slots 82 in the fixture 20 to secure the louver assembly 76 to the fixture. The torsion springs 80 allow the louver assembly to be removed and replaced with other types of louver assemblies or diffuser assemblies which are also provided with torsion springs. The interchangeable louver assembly and lens frame assembly provide further versatility of the lighting system.

FIG. 10 also shows a standard support bracket or earthquake bracket 62 which may be attached to the fixture at a mounting bracket 63 by a screw 66. The support bracket 62 allows the fixture to be clamped to the ceiling grid.

While the invention has been described in detail with reference to a preferred embodiment thereof, it will be apparent to one skilled in the art that various changes can be made, and equivalents employed without departing from the spirit and scope of the invention.

What is claimed is:

1. A modular lighting system adaptable for use in a variety of lighting applications, comprising:

a plurality of lighting fixtures, each of said lighting fixtures including a housing sized to be received in a six inch wide ceiling grid planning module of a suspended ceiling grid, said lighting fixtures configured to be received from above in the suspended ceiling grid and supported by an equal interval spaced grid of transverse and longitudinal ceiling grid suspension members and an electrical connection adapted to receive a T8 fluorescent lamp.

2. The modular lighting system of claim 1, wherein the plurality of lighting fixtures are arranged in twin-paks.

3. The modular lighting system of claim 1, wherein the plurality of lighting fixtures are arranged in rows.

4. The modular lighting system of claim 1, further comprising corner transition fixtures including a housing sized to be received in a six inch by six inch on center ceiling grid and an electrical connection adapted to receive a compact fluorescent lamp.

5. A lighting fixture for use in an overhead lighting system, comprising:

an elongated housing having an interior and an exterior surface;

means for supporting a T8 fluorescent lamp in the interior of said housing so that the lamp extends along a longitudinal length of the housing;

reflectors positioned along the interior of the housing on opposite side surfaces of the housing;

shielding means mounted in the housing for directing light from the fluorescent lamp; and wherein the exterior surface of the elongated housing is sized to be received from above in a six inch by four foot ceiling grid of a suspended ceiling having six inch planning modules.

6. The lighting fixture according to claim 5, further comprising means for attaching the elongated housing to a second elongated housing so that two fixtures may be mounted side by side.

7. The lighting fixture according to claim 6, wherein the means for attaching comprises a pair of end brackets which are attached to ends of two housings.

8. The lighting fixture according to claim 5, further comprising at least one support bracket which is adjustably attachable to the exterior of the housing for securing the housing to a ceiling grid.

9. The lighting fixture according to claim 8, wherein the support bracket includes spring biased clamping members.

10. The lighting fixture according to claim 5, wherein the maximum total depth of the housing 4.125 inches.

11. The lighting fixture according to claim 5, wherein the maximum total depth of the housing is 3.5 inches.

12. The lighting fixture according to claim 5, wherein an interior aperture measured perpendicular to the longitudinal length of the housing has a maximum width of 4.6 inches.

13. The lighting fixture according to claim 5, wherein the shielding means is removably mounted in the housing with a mounting means.

14. The lighting fixture according to claim 5, wherein the exterior of the housing is provided with flanges positioned at a lower edge of each longitudinally extending side surface, the flanges being configured to support the housing on a ceiling grid and to support a ceiling tile on an upper surface of the flanges when no ceiling grid is present.

15. A lighting fixture for use in an overhead lighting system, comprising:

an elongated housing having an interior and an exterior surface;

means for supporting a T8 fluorescent lamp in the interior of said housing so that the lamp extends along a longitudinal length of the housing;

reflectors positioned along the interior of the housing on opposite side surfaces of the housing;

shielding means mounted in the housing for directing light from the fluorescent lamp, said shielding means removably mounted in the housing with a mounting means;

wherein the exterior surface of the elongated housing is sized to be received in a six inch by four foot planning module; and wherein the mounting means includes a torsion spring.

16. A modular lighting system adaptable for use in a variety of lighting applications, comprising:

a plurality of lighting fixtures, each of said lighting fixtures including a housing sized to be received in a standard planning module of a suspended ceiling grid, the ceiling grid including main T-sections mounted at equally spaced intervals and crossed T-sections connecting the main T-sections at equally spaced intervals to form rectangular ceiling grids for receiving ceiling panels, each of the main T-sections and the cross T-sections having notches formed along their lengths at intervals equal to the standard planning module, the planning module having a width of six inches or less, an electrical connection provided within the plurality of lighting fixtures which is adapted to receive a T8 fluorescent lamp.

17. The modular lighting system of claim 16, wherein the plurality of lighting fixtures are arranged side by side in twin-packs.

18. The modular lighting system of claim 16, wherein the plurality of lighting fixtures are arranged end to end in rows.

19. A modular lighting system for use in a ceiling grid system having a ceiling grid planning module size, the ceiling grid including main T-sections mounted at equally spaced intervals and cross T-sections connecting the main T-sections at equally spaced intervals to form rectangular ceiling grids for receiving ceiling panels from above, wherein the equally spaced intervals of the main T-sections and the cross T-sections are equal to a multiple of the ceiling grid planning module size, each of the main T-sections and the cross T-sections having notches formed along their lengths at intervals equal to the ceiling grid planning module size, the modular lighting system comprising:

a plurality of lighting fixtures, each of said lighting fixtures including a generally rectangular housing having four sides for receiving a single fluorescent lamp having a predetermined size, the housing having a width equal to or less than the ceiling grid planning module size such that the housing may be received in from above the ceiling grid; and wherein when the equally spaced intervals of the main T-sections and the cross T-sections are equal to the ceiling grid planning module size, the housing is supported along four sides by the ceiling grid.

20. The modular lighting system according to claim 19, wherein the ceiling grid planning module size is six inches or less.

21. The modular lighting system according to claim 19, wherein the predetermined size of the single florescent lamp is no greater than a size T8 lamp.

22. The modular lighting system according to claim 19, wherein the main T-sections and cross T-sections are arranged in the ceiling grid such that four of the plurality of lighting fixtures will fit within one rectangular ceiling grid.

23. A modular lighting system for use in a ceiling grid system having a ceiling grid planning module size, the ceiling grid including main T-sections mounted at equally spaced intervals and cross T-sections connecting the main T-sections at equally spaced intervals to form rectangular ceiling grids for receiving ceiling panels from above, wherein the equally spaced intervals of the main T-sections and the cross T-sections are equal to a multiple of the ceiling grid planning module size, each of the main T-sections and the cross T-sections having notches formed along their lengths at intervals equal to the ceiling grid planning module size, the modular lighting system comprising:

a plurality of lighting fixtures, each of said lighting fixtures including a generally rectangular housing having opposing longitudinal and transverse side surfaces for receiving a single fluorescent lamp having a predetermined size, the housing having a width equal to or less than the ceiling grid planning module size such that the housing may be received in from above the ceiling grid;

wherein the housing is supported along at least two side surfaces by the ceiling grid; and wherein the housing is provided with a flange positioned at a lower edge of at least one side surface, the flange supporting a ceiling tile on an upper surface thereof.

* * * * *